United States Patent [19]

Scott

[11] 4,131,433

[45] Dec. 26, 1978

[54] FUEL ADDITIVES, ADDITIVE COMPOSITIONS AND METHODS OF EMPLOYING SAME TO PREVENT CORROSION OF METAL SURFACES IN CONTACT WITH HOT GASEOUS COMBUSTION PRODUCTS

[75] Inventor: James F. Scott, Mt. Kisco, N.Y.

[73] Assignee: The Perolin Company, Inc., Wilton, Conn.

[21] Appl. No.: 819,339

[22] Filed: Jul. 27, 1977

[51] Int. Cl.[2] ..... C01L 1/28

[52] U.S. Cl. ..... 44/51; 44/68; 44/76; 44/DIG. 3

[58] Field of Search ..... 44/DIG. 3, 51

[56] References Cited

U.S. PATENT DOCUMENTS 3,994,699 11/1976 Scott ..... 44/DIG. 3

FOREIGN PATENT DOCUMENTS 634000 1/1962 Canada ..... 44/DIG. 3
502130 4/1951 France ..... 44/DIG. 3
761378 11/1956 United Kingdom ..... 44/DIG. 3

*Primary Examiner*—Allen B. Curtis
*Attorney, Agent, or Firm*—Cooper, Dunham, Clark, Griffin & Moran

[57] ABSTRACT

A fuel additive composition useful for incorporation in or admixture with fuels, particularly fuels containing vanadium and/or sodium as a contaminant such that upon combustion of the fuels containing or in the presence of said additive composition metal surfaces in contact with the resulting hot gaseous fuel combustion products are subject to less corrosion, contains one or more compounds providing the elements or elemental components magnesium, silicon, chromium and chlorine, these elements Mg, Si plus Cr, Cl being present in the additive composition in the weight ratio 1/>0.5/>1.0, respectively, the amount of Si to Cr being in the ratio 1:0.1-10.

46 Claims, No Drawings

FUEL ADDITIVES, ADDITIVE COMPOSITIONS AND METHODS OF EMPLOYING SAME TO PREVENT CORROSION OF METAL SURFACES IN CONTACT WITH HOT GASEOUS COMBUSTION PRODUCTS

This invention relates to fuel additives, additive compositions, fuels containing the fuel additives and methods of employing the same to prevent, inhibit or reduce ash deposition and corrosion of metal surfaces in contact with hot gaseous combustion products.

In one embodiment this invention is concerned with additives and additive compositions useful for incorporation in fuels, particularly fossil fuels, including coal, coal derived liquid and gaseous fuels, shale oil fuels, particularly petroleum fuels, especially ash-containing fuels, such as petroleum fuels containing vanadium and/or sodium contaminants therein, such that such fuels can be used and combusted to yield hot gaseous combustion products which are less likely to seriously foul or deteriorate metal surfaces in contact with the resulting hot gaseous fuel combustion products. In another embodiment this invention is concerned with carrying out a combustion process such that the hot gaseous combustion products are less likely to seriously foul or deteriorate metal surfaces in contact therewith. In a special embodiment this invention is directed to a method of operating a gas turbine at a high operating temperature, e.g. metal or blade temperatures of about 1800° F. and higher, such as in the range 1600°-1900° F., such that the gas turbine can be operated with hot gaseous vanadium containing and/or sodium containing combustion products at such elevated temperatures for a prolonged period of time without serious ash deposition, deterioration or corrosion to metal surfaces or blade surfaces in contact with the hot gaseous combustion products driving the gas turbine.

Many additive materials and fuel compositions containing additives have been proposed to eliminate or substantially reduce corrosion of metal surfaces in contact with hot gaseous combustion products, see particularly U.S. Pat. Nos. 2,560,542, 2,631,929, 3,085,868, 3,205,053, 3,581,491, 3,817,722, 3,923,473, 3,926,577 and 3,994,699. The disclosures of the above-identified patents are herein incorporated and made part of this disclosure.

For the most part, however, fuel additive compositions known heretofore have not been completely satisfactory and, indeed, fuel additive compositions suitable for use in connection with the operation of a high temperature gas turbine wherein the gas turbine is operated at high metal temperatures of above about 1700° F. and employing vanadium and/or sodium containing fuels, have not been satisfactory. The operation of a high temperature gas turbine with fuels containing vanadium and/or sodium has presented a difficult problem, since the metal surfaces exposed to the vanadium-containing and/or sodium-containing hot gaseous combustion products are subject to catastrophic attack at temperatures of about 1700° F. and higher.

Considerable success has been achieved in avoiding, reducing or alleviating high temperature ash deposition and corrosion problems in connection with the operation of the gas turbine when additive compositions of the type described in U.S. Pat. Nos. 3,817,722 and 3,994,699 have been employed. When, however, even the additive compositions of these patents are employed in connection with the operation of a gas turbine operated at significantly high temperatures, such as metal temperatures of about 1700°-1800° F. and higher, improvement in protecting such metal surfaces from attack by the hot combustion products remains to be realized.

It is an object of this invention to provide an improved additive composition suitable for use in connection with the combustion of fossil fuels, such as petroleum or coal based or derived fuels, particularly ash-containing fuels, e.g. vanadium and/or sodium-containing fossil fuels.

It is another object of this invention to provide fuel compositions, especially petroleum-based fuel compositions, e.g. distillate petroleum fuels, or residual petroleum fuels or mixtures thereof, or crude oils, useful for the operation of a gas turbine for sustained periods of time at elevated temperatures, e.g. wherein metal temperatures of the gas turbine, such as blade temperatures, are about 1700° F. and higher.

Yet another object of this invention is to provide the capability of operating a gas turbine over a substantial period of time when operating on hot gaseous vanadium and/or sodium containing combustion products, such as are derived from the combustion of vanadium and/or sodium-containing fuels, without any substantial attack or deterioration of the hot metal surfaces, such as the turbine blades, in contact with the hot gaseous combustion products driving the turbine.

How these and other objects of this invention are achieved will become apparent in the light of the accompanying disclosure. In at least one embodiment of the practices of this invention at least one of the foregoing objects will be achieved.

It has been discovered that a fuel additive composition containing one or more compounds providing or containing the elemental components or elements magnesium, silicon, chromium and chlorine wherein these elements Mg, Si plus Cr, Cl are present in the additive composition in the weight ratio 1/>0.5/>1.0, respectively, the Si and Cr being in the weight ratio 1:0.1-10, provides a superior additive composition for incorporation in or admixture with fuels, such as fossil fuels, containing vanadium and/or sodium as contaminants. It is a special feature of the additive compositions in accordance with this invention that the compound or compounds of the additive composition containing or providing the elements silicon and magnesium are capable of forming or provide the compounds $SiO_2$ and MgO, respectively, in the hot gaseous fuel combustion products in a weight ratio greater than 1 part $SiO_2$ to 1 part MgO, such as in the weight ratio, 2 or 3, preferably greater than 6, even higher, e.g. 8-16. Suitable fuel compositions in accordance with the invention provide the weight ratio of the elements magnesium, silicon, chromium and chlorine therein in the ratio 1/1-8/0-.4-10/3-10, respectively, such as a weight ratio of these elements 1/1.5/0.5/5.5 or 1/2.3/1/5.5.

The additive compositions of this invention providing or containing the elements magnesium, silicon plus chromium and chlorine in the weight ratio 1/>0.5/>1.0, respectively, with a derivative $SiO_2$/-MgO weight ratio greater than 1, can be made up of a wide variety of compounds, organic or inorganic compounds or combinations thereof, e.g. metallo-organo compounds or mixtures of inorganic and organic compounds. For example, the magnesium elemental component of the additive compositions of this invention may be provided by substantially any magnesium-containing compound which, in contact with hot combustion products, is capable of providing magnesium oxide. Magnesium-containing compounds which are suitably employed in the practices of this invention to provide the elemental magnesium component include water-soluble inorganic magnesium-containing compounds as magnesium sulfate, magnesium chloride, magnesium nitrate, as well as substantally water-insoluble inorganic magnesium compounds, such as magnesium oxide, magnesium hydroxide, magnesium carbonate, the magnesium-containing clays, natural or synthetic magnesium silicate, and numerous other magnesium compounds.

Organic magnesium-containing compounds which are also usefully employed in the make-up of the additive compositions in accordance with this invention include magnesium acetate, the magnesium sulfonates, particularly the magnesium petroleum sulfonates, the magnesium naphthenates, the magnesium salts of the higher molecular weight carboxylic acids, such as magnesium octoate, magnesium oleate. It is preferred in the practices of this invention to employ an oil-soluble magnesium-containing compound to contribute the elemental magnesium component of the additive composition of this invention. Suitable such oil-soluble magnesium compounds include the aforementioned magnesium sulfonates, the higher molecular weight carboxylic acids, especially the magnesium salts of organic acids, such as the higher molecular weight aliphatics, naphthenics and petroleum sulfonic acids, including the magnesium petroleum sulfonates, magnesium naphthenates and the like. Also useful in the preparation of the additive compositions are the magnesium clays including natural and synthetic magnesium silicates, especially the oil-dispersible magnesium clays, since these materials or compounds serve as sources for both the elemental magnesium component and the elemental silicon component of the additive compositions.

Compounds which provide the elemental silicon component of the additive compositions of this invention, including silicon dioxide, may be inorganic silicon-containing compounds or organic silicon-containing compounds which, when subjected to the combustion temperatures or present in the combustion zone associated with the fuel, either introduced into the combustion zone along with the fuel or separately introduced therein, provide or are capable of providing silicon dioxide or $SiO_2$. Suitable such silicon-containing compounds include, as indicated hereinabove, the silicon-containing clays, the inorganic silicates, e.g. magnesium silicate, as well as the alkaline earth metal silicates and other metal silicates including chromium-containing silicates. Silicon dioxide itself is a useful component in the make-up of the additive composition in accordance with this invention because of its ready availability and low cost.

Organic silicon-containing compounds are especially useful, particularly the silicones, e.g. the polysilicones or polysiloxanes, especially those polysilicones which contain a high proportion by weight $SiO_2$, such as polysilicones having an $SiO_2$ content above about 30% by weight, e.g. in the range 40–62% by weight. In addition to the silicones, the lower alkyl silicates, such as the $C_1$–$C_6$ alkyl silicates, e.g. the tetra lower alkyl orthosilicates, as well as the mixed alkyl silicates, and polysilicates, are useful.

Desirably, the compound or material providing the elemental silicon component of the additive composition is oil-soluble and/or oil-dispersible. Although, as indicated herein-above, water-soluble and/or water-dispersible silicon-containing compounds are equally useful in the preparation of the additive compositions in accordance with this invention. Additionally, and in general, silicon-containing compounds useful in the practices of this invention include the various halosilanes, such as dichlorosilane, trichlorosilane, silicane cyanate, silicane diimide, silicane isocyanate, the silicic acids, such as di- and meta-silicic acids, silicon acetate, silicon sulfides, as well as the various siloxanes.

The elemental chromium component of the additive composition in accordance with this invention is capable of being provided, like all the other elemental components, by inorganic or organic chromium-containing compounds. Like the silicon and magnesium components of the additive compositions in accordance with this invention, the chromium component is capable of providing or provides $Cr_2O_3$ in the hot gaseous combustion products, or is capable of reacting or being decomposed in the combustion zone or when combusted with the fuel containing the chromium component to yield a chromium oxide, such as $Cr_2O_3$.

Chromium compounds which are useful in the preparation of the additive compositions in accordance with this invention include the inorganic chromium compounds, such as $CrO_3$ and chromic acid, the chromium sulfates, the chromium nitrates, chromium oxychloride, the chromium bromides, the chromium chlorides, the ammonium chromates and chromium silicide. The organic chromium-containing compounds, such as the chromium naphthenates, chromium acetate, the chromium complexes, chromium oxalate, chromium acetylacetonate chromium succinate, chromium isooctadecyl succinic anhydride, the chromium salts of the higher molecular weight aliphatic carboxylic acids, such as chromium octoate, chromium oleate, chromium salts of tall oil fatty acids.

Desirably, as indicated hereinabove, with respect to the silicon and magnesium-providing component compounds of the additive composition, the chromium-providing compound is oil-soluble or oil-dispersible, although water-soluble or water-dispersible chromium compounds are also useful. Like the magnesium silicates which provide both the magnesium and silicon component, the chromium chlorides could usefully provide the chromium and chlorine component of the additive compositions or mixed salts of chromium, such as with magnesium, could also provide in one compound two, three or more of the elemental components of the fuel additive compositions in accordance with this invention, e.g. magnesium, chromium and/or chlorine or magnesium, chromium and/or silicon.

The remaining component of the additive composition in accordance with this invention, chlorine, as indicated herein-above, can readily be provided by compounds which contain another of the elemental components in accordance with this invention, such as magnesium chloride, chromium chlorides, silicon and chlorine-containing compounds, such as silicon tetrachloride. In general, chlorine-containing compounds useful in the practices of this invention include, in addition to the aforesaid chlorine-containing compounds, other inorganic and organic chlorine-containing compounds. Particularly preferred in the preparation of the additive compositions in accordance with this invention are the chlorinated hydrocarbons, such as the chlorinated aliphatic hydrocarbons, e.g. chlorinated $C_1$–$C_{10}$ alkanes, and chlorinated aromatic hydrocarbons, e.g. chlorinated $C_6$–$C_{18}$ aromatic hydrocarbons, including benzene, toluene and the xylenes, such as orthodichlorobenzene, and other alkyl substituted aromatic hydrocarbons or aromatic substituted aliphatic or alkyl hydrocarbons. Especially preferred in the practices of this invention in addition to orthodichlorobenzene is the chlorinated $C_2$ alkane, 1,1,1-trichloroethane. This compound provides not only a convenient source of chlorine for use in the make-up of the additive compositions in accordance with this invention but also is readily soluble in petroleum based or derived liquid fuel compositions and exhibits excellent solvent power, especially in combination with petroleum naphtha fractions, for compounds, such as the polysilicones and chromium naphthenates and magnesium sulfonates, which are especially suitable for use in the preparation of additive compositions in accordance with this invention. Also suitable are halogenated aromatic hydrocarbons, orthodichlorobenzene and other chlorinated benzenes, xylenes and toluenes.

Although, as indicated hereinabove, the compounds to provide the various elemental components, magnesium, silicon, chromium and chlorine of the additive compositions in accordance with this invention can be separately or together incorporated into the fuel prior to the combustion of the fuel or separately or together into admixture with the fuel just prior to combustion or separately or together into the combustion zone during combustion of the fuel, it is preferred that the additive compositions in accordance with this invention be prepared or compounded in the form so as to be readily incorporated in or dispersible in or soluble in the fuel or the liquid hydrocarbon or petroleum fuels, either distillate or residual hydrocarbon fuels or crude oils. The compounds in accordance with this invention to provide the required elemental components, magnesium, silicon, chromium and chlorine in the desired weight ratio are preferably oil-soluble or oil-dispersible compounds. The resulting fuel additive composition could therefore be readily dispersed or stably mixed with fuel oils in the desired proportion. Accordingly, it would be desirable to employ as a solvent for the compounds employed in the practices of this invention solvents which are compatible or miscible with liquid hydrocarbon fuels, particularly liquid petroleum fuels, residual or distillate fractions or mixtures thereof or crude oils.

Particularly useful solvents for the combination of compounds of this invention and exhibiting solvent power, by way of example, for a high silicon dioxide content polysilicone, magnesium sulfonates, such as the magnesium petroleum sulfonates, and chromium naphthenate, as well as being miscible with the preferred chlorine-contributing compound, 1,1,1-trichloroethane, are the petroleum naphtha fractions especially the heavy petroleum naphtha fractions. Especially suitable are the heavy petroleum naphtha fractions having a boiling point range in the range from about 200° F. to about 700° F., more or less. Of these heavy petroleum naphtha fractions, the heavy aromatic naphtha fraction is preferred wherein the aromatic content is greater than 30% by weight and preferably comprises a major amount by weight of the naphtha, such as in the range 50–80% by weight or higher. Such heavy aromatic naphtha fractions useful in the solvent would have a boiling point range in the range 225°–650° F. It is mentioned, however, that aromatic solvents are not required, but preferred. Substantially any solvent and/or diluent is useful.

In the preparation of the fuel additive compositions in accordance with this invention the compounds providing or contributing the elemental magnesium, silicon, chromium and chlorine components preferably comprise as high a percent by weight of the additive composition as practical. This is desirable since a smaller volume or amount by weight of such compositions would more readily provide sufficient additive composition to be effective for a given amount of fuel. For example, it is preferred in the practices of this invention that the compounds contributing the elemental components in accordance with this invention comprise a major amount by weight of the additive fuel composition, the remaining portion being comprised of other materials, such as, for instance, surfactants, e.g. wetting agents, which may be required to maintain the compounds in solution or in stable dispersion. Desirably, the solvent portion of the fuel additive compositions, i.e. the solvent portion, such as the heavy naphtha fraction, which does not contribute to the elemental components magnesium, silicon, chromium and chlorine of the additive composition, should make up not more than about 15–30% by weight, preferably not more than 50% by weight, of the fuel additive composition. The remaining percent by weight of the fuel additive composition should be comprised of or made up of or consist essentially of the elemental magnesium, silicon, chromium and chlorine-contributing components, thereof, all in the ratios as described hereinabove.

Although the preferred solvent in the practices of this invention is a substantially 50–50% by weight mixture of a heavy aromatic naphtha fraction and 1,1,1-trichloroethane, other solvents or diluents, as indicated hereinabove, might also be usefully employed, such as low grade fuels including residual fuel oil, as well as distillate petroleum fuel oil fractions, e.g. kerosene or gas oil boiling range fractions or diesel oil as well as aromatic hydrocarbons, such as benzene, toluene, xylenes, naphthalenes or alkyl naphthalenes. Such other solvents or diluents would serve to blend better the fuel additives into the fuel oil to be combusted. Aromatic hydrocarbon fractions, either derived from petroleum or synthetically prepared or derived from coal tar by the distillation of soft coal, are also useful. As indicated hereinabove, the corresponding chlorinated hydrocarbon fractions are especially useful not only because of their high solvent power but also due to the fact that such chlorinated hydrocarbon fractions contribute to the elemental chlorine component in the make-up of the fuel additive compositions.

As indicated hereinabove, the compounds which contribute the elemental components magnesium, silicon, chromium and/or chlorine should comprise a major amount of the fuel oil additive composition, preferably at least 30–50% by weight of the make-up of the additive compositions and conceivably such additive compositions could comprise 100% by weight of the elemental component contributing compounds.

In the practices of this invention, i.e. when the fuel oil additive is utilized in a combustion operation in order to protect the metal surfaces from corrosion or deterioration upon contact with hot combustion gases, the additive compositions are utilized within the combustion zone or introduced thereinto, separately or in combination with the fuel, or directly into the combustion gases, in an amount such that a minor amount of the additive composition is employed relative to the fuel. By way of example, a fuel oil composition, either a distillate fraction or residual fraction or a mixed distillate and residual fraction or crude oil, would contain admixed therewith a minor amount of the additive composition containing the elemental or providing components (magnesium, silicon, chromium and chlorine) in accordance with this invention, such as an amount in the range from about 0.001% by weight based on said fuel up to about 5% by weight based on said fuel, e.g. in the range 0.01–2% by weight based on said fuel. If the fuel contains a substantial amount of ash-forming constituents or contaminants therein, e.g. V and/or Na, then such fuel would require substantially higher amounts of the fuel additive compositions in accordance with this invention as compared with a fuel which has a low ash or V and/or Na content. Further, the amount of additive composition employed relative to the fuel should be that the additive composition provides at least about 0.05 part by weight combined $SiO_2$ and MgO for each part by weight of ash in said fuel, such as an amount in the range of 0.05–1.0.

Although in the practices of this invention the additive compositions are especially effective when used in association with fossil fuels, such as coal and/or petroleum based and/or derived fuels, especially residual fractions thereof which tend to have a relatively high ash content and/or contain vanadium compounds and/or sodium compounds as contaminants therein, the additive compositions are generally suitable for use in association with or in the combustion of a variety of solid fossil fuels, such as coal, high grade or low grade, coke, including petroleum coke, which may be pulverized and burned or after pulverization, mixed with a petroleum fuel oil, either residual and/or distillate fraction thereof, and burned.

The additive compositions in accordance with this invention are especially effective in connection with the combustion of petroleum fuels, either residual or distillate fractions thereof, particularly petroleum fuel oils which contain greater than 0.5 vanadium as a contaminant therein, such as in the range 3–50 ppm V and higher. It is mentioned that it frequently happens because of the environment or handling of petroleum fuel oil, the fuel oil becomes contaminated with sodium compounds, such as salt. The combination of vanadium and sodium as contaminants in a fuel, particularly a fuel oil, for use in gas turbine operation is particularly difficult and challenging from the point of view of attenuating high temperature corrosion of and deposits on metal surfaces in contact with the hot combustion gases containing vanadium and sodium compounds as contaminants. Sodium as a contaminant, even if not initially present in the fuel oil just prior to combustion, might be taken thereinto from the air used for combustion, such as from salt water spray in the combustion air, with the result that although the fuel might be substantially free of sodium or salt contamination the gaseous combustion products would contain a substantial sodium contamination level due to the ingestion of sodium chloride-containing sea water spray with the air employed in the combustion process. The additive compositions in the practices of this invention, as indicated hereinabove, are particularly useful in combatting corrosion due to vanadium and sodium contamination, present either in the fuel or in the fuel combustion products, either initially derived from the fuel or introduced during the combustion process.

As indicated hereinabove, the compositions of this invention are particularly useful in connection with the operation of a gas turbine wherein the metal surfaces of the gas turbine, e.g. vanes or blades, are exposed to a relatively high metal temperature of at least about 1400° F., such as in the range 1600°–1800° F. It is desirable to operate gas turbines at as high a temperature as possible. Heretofore, it has not been feasible to operate gas turbines at blade or metal temperatures of 1600° F. or higher, particularly when the fuel employed contains significant amounts of vanadium and/or sodium contaminants therein. By the use of the additive compositions in accordance with this invention fuel oils, such as crude oils and residual fuel oils, containing vanadium and sodium contaminants which contaminants also appear in the hot gaseous combustion products, can be employed for the operation of gas turbines at higher metal or blade temperatures of 1800° F. and for a substantial period of time without catastrophic corrosion or serious deterioration of the metal surfaces exposed to the hot gaseous combustion products. In this respect, the additive compositions of this invention and their use in the operation of a high temperature gas turbine provide a substantial breakthrough and commercial advantage, particularly with respect to the use of vanadium and/or sodium contaminated fuels for gas turbine operation.

Vanadium contamination in petroleum fuels depends not only upon the source of the petroleum fuel, i.e. the origin or location of the petroleum crude from which the fuel is derived, but also upon the processing or refining techniques which the fuel has undergone prior to utilization as fuel. Crude oils contain as contaminants various amounts of vanadium compounds, small amounts as low as about 0.1–0.5 part by weight vanadium and large amounts such as 3–10 up to as high as 30–60 parts by weight vanadium and higher. Similarly, crude oils may contain a substantial level of sodium contamination, usually as sodium chloride, from a level, substantially insignificant, as low as 0.5 part per million to significant amounts in the range 10–100 parts per million by weight and higher.

Even at relatively low levels, a fuel, e.g. crude oil, containing about 5 ppm V and 3 ppm Na offers a substantial challenge to the manufacture and operator of a gas turbine which is operated by the combustion of such fuels and at an operating or metal temperature of about 1700°–1800° F. Heretofore, the operation of gas turbine under such conditions with such a fuel, e.g. 5 ppm V and 3 ppm Na has not been feasible. The additive compositions of this invention, however, would provide a substantially increased turbine operating life and substantially reduced metal corrosion and deterioration when incorporated in petroleum fuels containing the above-indicated level of vanadium, e.g. in the range 1–20 ppm V and sodium, e.g. in the range 1–20 ppm Na, for the operation of a gas turbine at a metal temperature of the order of 1800° F.

The following is exemplary of the practices of this invention. Tests were carried out to demonstrate the utility of the practices of this invention, particularly the addition of the additive compositions of this invention to a sodium and vanadium contaminated fuel. A number of tests using special equipment were conducted on metal specimens simulating conditions to which actual gas turbine blades are exposed. Special equipment for such tests is described and illustrated in Paper No. 70-WA/CD-2, an ASME publication presented at the Annual Meeting in New York, N.Y., Nov. 30–Dec. 3, 1970 of The American Society of Mechanical Engineers and entitled "Laboratory Procedures for Evaluating High-Temperature Corrosion Resistance of Gas Turbine Blades". The metal specimens employed in the tests were made of Udiment 500 (U-500), a nickel alloy containing Co, Cr, Al and Ti, a cobalt alloy X-45 containing Cu, Ni and W, all described in the above paper. Other alloys employed in the tests were Inco 738, a nickel and chromium alloy and Inco 713C, another high temperature oxidation resistant alloy. In carrying out these tests a fuel oil simulating an Arabian crude and containing 5 ppm V and 3 ppm Na, was employed. The fuel was combusted so as to expose the alloy specimens to a metal temperature maintained at 1800° F. in contact with the fuel combustion products and in these tests the corrosion or surface deterioration of the tested metal specimens was examined after a certain period of time and evaluated by measurement of the loss of weight in milligrams of the test specimens per square centimeter and penetration of the alloy substrate.

In the preparation of the additive compositions employed in these tests there was employed a mixture containing 21 parts by weight of a heavy aromatic naphtha, 21 parts by weight 1,1,1-trichloroethane, 26 parts by weight of polysilicone having an $SiO_2$ content of about 58% and 32 parts by weight magnesium petroleum sulfonate. The resulting admixture provided an equivalent of 15 parts by weight $SiO_2$, 5 parts by weight MgO and about 17 parts by weight Cl. In accordance with this invention there was also added to the fuel chromium naphthenate as additive in the amount to provide a chromium to sodium weight ratio of 5:1, the additive chromium being relative to the Na content in the fuel.

In an oxidation test involving the alloy test specimens with no additive added and no vanadium or sodium present in the fuel, after 50 hours exposure to the combustion gases at a metal temperature of 1800° F. the U-500 alloy test specimen exhibited a loss of 9.5 milligrams per square centimeter. The X-45 test specimen under the same conditions after 50 hours exhibited a loss of 11 milligrams per square centimeter. After 150 hours the X-45 alloy test specimen showed a loss of 18 milligrams per square centimeter and the U-500 alloy test specimen a loss of 16 milligrams per square centimeter. These test results represent control tests and indicate the ability of the tested alloy to resist oxidation at a temperature of 1800° F. when exposed to combustion products of a clean non-contaminated distillate petroleum fuel.

Corrosion tests were carried out wherein there was incorporated into the simulated crude oil containing vanadium and sodium contaminants (5 ppm V and 3 ppm Na), a fuel additive of the type described in U.S. Pat. Nos. 3,817,722 and 3,994,699, but including a chromium component, such as chromium naphthenate. In one additive test sufficient additive was included in the fuel tested so as to provide in the combustion products a magnesium to vanadium weight ratio of 3:1, an $SiO_2$:MgO weight ratio of 3:1 and a silicon plus chromium weight ratio to sodium of 16.7:1, the Si plus Cr being made up of 11.7 parts Si and 5 parts Cr. A second additive test was conducted at a magnesium to vanadium weight ratio of 6:1, an $SiO_2$:MgO weight ratio of 3:1, and a corresponding increase in the silicon plus chromium weight ratio to 28.4:1 to determine the effect of additional additive concentration since the extent of the corrosion exhibited after exposure of the alloy test specimens to the resulting combustion products for a period of approximately 100 hours in the above initial additive test at 1800° F. was so catastrophic as not to be measurable. After 50 hours, however, a weight loss of approximately 200 mg/cm$^2$ and a radius recession or maximum penetration to virgin metal of 4.5 mils was measured on a U-500 nickel-base alloy specimen removed during the test period. For the significance and measurement of the radius recession or penetration test see the paper by P. A. Bergman et al entitled "Development of Hot-Corrosion-Resistant Alloys for Marine Gas Turbine Service", ASTM Special Technical Publication No. 421 of the Sixty-ninth Annual Meeting American Society for Testing and Materials, 1966. The disclosures of this publication are herein incorporated and made part of this disclosure. Examination of test specimens from this test indicated metal failure was due almost entirely to accelerated oxidation (vanadate attack), with only minor sulfidation observed. The effect of the increase in additive dosage in the second test referred to above and which was terminated after approximately 70 hours due to temperature control problems, showed visual evidence of some reduction of the corrosion rate observed in the first additive test. However, doubling the magnesium to vanadium weight ratio from 3:1 to 6:1, somewhat beneficial, did not provide any significant improvement in corrosion inhibition and, based on these tests, operation with such a vanadium and sodium containing fuel at 1800° F. metal temperature, even with the above additives, was considered impossible.

In another test employing the fuel additive in accordance with this invention sufficient fuel additive was incorporated in the fuel to yield an Mg:V weight ratio of 3:1, an $SiO_2$:MgO weight ratio of 3:1, a silicon plus chromium weight ratio of 16.7:1 made up of 11.7 Si and 5 Cr and a Cl:V weight ratio of 16.7:1. The additive concentration in this test was identical with that employed in the first additive test, however with the addition of the chlorine element. The fuel employed, as described hereinabove, was again a simulated Arabian crude containing 5 ppm V and 3 ppm Na. After exposure of the alloy test specimens to the hot combustion products at a metal temperature 1800° F. for a period of 96 hours, the alloy U-500 test specimen exhibited a corrosion weight loss of only 4.0 milligrams per square centimeter and the X-45 alloy test specimen has a loss of only 6.0 milligrams per square centimeter. The data of this test with respect to the additive composition in accordance with this invention show that after approximately 100 hours there was less than 50% corrosion exhibited by the alloy specimen U-500 compared with the same alloy test specimen which had been subjected essentially to oxidation conditions for a much shorter (½) period of time. Substantially similar results were obtained relative to the X-45 alloy test specimen. It is mentioned that with respect to the other alloy test specimens evaluated in the tests employing the fuel in accordance with the composition of this invention after 96 hours at 1800° F. the IN-738 alloy exhibited only a loss of 2.5 milligrams per square centimeter and the 713C alloy showed a corrosion weight loss of only 2.3 milligrams per square centimeter.

None of the nickel-based alloys showed any pittings or significant signs of sulfidation. The U-500 specimen showed a reduced radius recession of 0.8 mils in this test compared to 4.5 mils in the identical test without the addition of the chlorine element, and the nature of the deposits changed significantly using the additive in accordance with this invention. Without the addition of chlorine, the deposits formed on the front of the test specimens were heavier and harder than on the back side, while the addition of chlorine resulted in an even distribution of the deposit over the entire surface of the test specimen with no build-up on the front of the test specimen normally observed due to impaction and the deposits were soft, completely powdery, easily brushed off the metal specimens with no evidence of any of the deposits having been molten at any time.

The results of these tests which are summarized in the accompanying table convincingly show the vast improvement which results from use of the additive composition in accordance with this invention thus providing a significant improvement in gas turbine capabilities for operating on vanadium-sodium fuels at temperature levels heretofore not considered possible with concomitant increase in power output and efficiency.

TABLE

METAL TEMPERATURE : 1800° F.

| TEST NO. | ADDITIVE COMPOSITION | | FUEL QUALITY | | | | ADDITIVE/FUEL RATIOS | |
|---|---|---|---|---|---|---|---|---|
| | Elements | $SiO_2/MgO$ Equivalent Ratio | Vanadium ppm | Sodium ppm | Na/V Ratio | Mg/V | (Si+Cr)/Na | Cl/V |
| | None | | Distillate Fuel (Oxidation Data) | | | | None | |
| 1 | Mg:Si:Cr | 3/1 | 5 | 3 | 0.6/1 | 3/1 | 16.7/1 | — |
| 2 | Mg:Si:C. | 3/1 | 5 | 3 | 0.6/1 | 6/1 | 28.4/1 | — |
| 3 | Mg:Si:Cr:Cl | 3/1 | 5 | 3 | 0.6/1 | 3/1 | 16.7/1 | 16.7/1 |

| TEST NO. | TEST HOURS | CORROSION DATA wt. loss, $Mg/cm^2$ U-500 | 713C | IN-738 | X-45 | Radius Recession mils U-500 | DEPOSIT DATA |
|---|---|---|---|---|---|---|---|
| | 50 | 9.5 | | | 11.0 | | |
| | 150 | 16.0 | 8.5 | 17.5 | 18.0 | | |
| 1 | 50 | 200 | | | | 4.5 | Back - powdery deposit |
| | 150 | | Catastrophic | | | | Front - heavier and somewhat harder |
| 2 | 70* | (1) | | | | | |
| | | | Catastrophic | | | | |
| 3 | 96 | 4.0 | 2.3 | 2.5 | 6.0 | 0.8 | Soft, powdery completely uniform deposit over entire surface |

(1) Estimated corrosion rate - approximately ½ of Test #1
*Test terminated after 70+ hours due to temperature control problems The above tests clearly demonstrate the great superiority of the Mg, Si, Cl and Cr containing fuel additive composition in accordance with this invention as a fuel additive useful for incorporation in a fuel, such as a gas turbine fuel, to reduce corrosion and deposits due to the presence in the fuel of ash forming contaminants, particularly vanadium and sodium contaminants.

In the preparation of the fuel additive compositions in accordance with this invention, as indicated hereinabove, the fuel additive components which contribute the compounds or materials making up the additive and contributing the magnesium, silicon, chromium and chlorine elemental components, may be comprised in one or more compounds. These compounds in accordance with the practices of this invention could be oil-soluble or oil-dispersible with the result that the fuel additive compositions in accordance with this invention would be usefully employed in an oil or liquid hydrocarbon solution and readily mixed or incorporated in a fuel oil. Alternatively, the compounds making up the fuel additive composition of this invention could be substantially all water-soluble or water-dispersible in which event the fuel additive compositions of this invention could be in the form of a water solution or dispersion. Further, if the compounds making up the fuel additive composition are in part water-soluble and in part water-insoluble or all water-insoluble, stable aqueous dispersions of the water-insoluble compounds could be employed. Likewise, the compounds making up the fuel additive compositions in accordance with this invention could be in part oil-soluble and in part water-soluble, in which event the fuel additive compounds could be employed in the form of an oil-in-water emulsion or in the form of a water-in-oil emulsion. If desired, as indicated hereinabove, separate preparations, e.g. solutions or dispersions or emulsions of one or more compounds useful in the practice of this invention, could be prepared and such preparations separately employed under conditions to provide in the aggregate the desired amount of the elemental components magnesium, silicon, chromium and chlorine in accordance with the practices of this invention.

Also, if desired, the compounds making up the additive compositions of this invention could be employed in powder form or liquid form if such compounds are in the liquid state at ambient or slightly elevated temperature and pressure or in the gaseous form. When so employed the compounds of this invention could be directly introduced into the fuel before combustion of just prior to combustion or directly into the combustion chamber, such as in admixture with the combustion air or separately therefrom or into the combustion products before the combustion products enter the turbine, whereby the benefits of the practices of this invention would be obtained.

As will be apparent to those skilled in the art in the light of the foregoing disclosure, many modifications, alterations and substitutions are possible in the practices of this invention without departing from the spirit or scope thereof.

I claim:

1. A fuel additive composition useful for incorporation in or admixture with fuels such that upon combustion of the fuels or in the presence of said additive composition when introduced into the fuel combustion products, metal surfaces in contact with said combustion products are subject to reduced corrosion and ash deposition, said additive composition consisting essentially of one or more compounds containing the elements selected from the group consisting of magnesium, silicon, chromium and chlorine, said elements Mg, Si plus Cr, Cl being present in said additive composition in the weight ratio 1/>0.5/>1.0, respectively, the compound or compounds in said composition containing said elements silicon and magnesium forming or providing the compounds $SiO_2$ and MgO, respectively, in said combustion products in the weight ratio of at least 1 part $SiO_2$ to 1 part of MgO.

2. A fuel additive composition in accordance with claim 1 wherein said elements silicon and chromium are present in the weight ratio 1:0.1–10.0, respectively.

3. A fuel additive composition in accordance with claim 1 wherein said elements magnesium, silicon plus chromium and chlorine are in the weight ratio about 1/3.3/5.5.

4. An additive composition in accordance with claim 1 wherein said elements magnesium, silicon, chromium and chlorine are present in said composition in amounts in the weight ratio 1/1–8/0.5–4/3–10.

5. A fuel additive composition in accordance with claim 1 wherein said elements magnesium, silicon plus chromium and chlorine are present in the weight ratio 1/0.5–20/1–50, respectively.

6. A fuel additive composition in accordance with claim 1 wherein the element magnesium is present as magnesium sulfonate in said composition.

7. A fuel additive composition in accordance with claim 1 wherein the element silicon is present as an organic silicon-containing compound in said composition.

8. A fuel additive composition in accordance with claim 1 wherein the element chromium is present as an organic chromium-containing compound in said composition.

9. A fuel additive composition in accordance with claim 1 wherein the element chlorine is present as an organic chlorine-containing compound, such as orthodichlorobenzene or 1,1,1-trichloroethane, in said composition.

10. A fuel additive composition in accordance with claim 1 wherein said elements magnesium, silicon, chromium and chlorine are present in said composition in the form of the compounds magnesium sulfonate, polysilicone or polysiloxane, chromium naphthenate and 1,1,1-trichloroethane, respectively.

11. A fuel additive composition in accordance with claim 1 wherein the elements magnesium, silicon, chromium and chlorine are present in said composition in the form of the compounds magnesium sulfonate, polysilicone, an organic chromium-containing compound and 1,1,1-trichloroethane, respectively.

12. A fuel additive composition in accordance with claim 1 wherein the element silicon is present in said composition in the form of polysilicone containing about 30–60% by weight $SiO_2$.

13. A fuel additive composition in accordance with claim 1 wherein said elements magnesium, silicon and chlorine are present in the form of one or more organic compounds containing said elements.

14. A fuel additive composition in accordance with claim 1 wherein said elements magnesium, silicon, chromium and chlorine are present in the form of one or more organic compounds containing said elements.

15. A fuel additive composition in accordance with claim 1 wherein said elements magnesium, silicon and chlorine are present in the form of one or more inorganic compounds containing said elements.

16. A fuel additive composition in accordance with claim 1 wherein said elements magnesium, silicon, chromium and chlorine are present in the form of one or more inorganic compounds containing said elements.

17. A fuel additive composition in accordance with claim 1 wherein said elements magnesium, silicon and chlorine are present in the form of one or more organic and/or inorganic compounds containing said elements.

18. A fuel additive composition in accordance with claim 1 wherein said elements magnesium, silicon, chromium and chlorine are present in the form of one or more organic and/or inorganic compounds containing said elements.

19. A fuel additive composition in accordance with claim 1 wherein said additive composition is dissolved in a hydrocarbon-containing solvent.

20. A fuel additive composition in accordance with claim 1 wherein said additive composition is dissolved in a hydrocarbon-containing solvent admixture comprising a heavy aromatic naphtha hydrocarbon and a normally liquid chlorinated hydrocarbon, said chlorinated hydrocarbon additionally providing the element chlorine of said composition.

21. A fuel additive composition in accordance with claim 20 wherein said hydrocarbon-containing solvent admixture contains substantially equal amounts by weight said heavy aromatic naphtha and said normally liquid chlorinated hydrocarbon.

22. A fuel additive composition in accordance with claim 20 wherein said solvent admixture comprises 42% by weight of said composition, said solvent admixture comprising substantially equal amounts by weight said heavy aromatic naphtha and said chlorinated hydrocarbon.

23. A fuel additive composition in accordance with claim 1 wherein said additive composition is dissolved in a hydrocarbon-containing solvent admixture comprising substantially equal amounts by weight of a heavy aromatic naphtha hydrocarbon and 1,1,1-trichloroethane, the silicon element component of said additive composition being provided by a polysilicone or silicate ester containing about 30–60% by weight $SiO_2$, the magnesium element component of said composition being provided by magnesium sulfonate, the chromium element component of said composition being provided by chromium naphthenate and the chlorine element component of said composition being provided by the aforesaid 1,1,1-trichloroethane.

24. A fuel composition comprising a fuel and a minor amount of a fuel additive composition based on said fuel of a fuel additive in accordance with claim 1.

25. A fuel composition in accordance with claim 24 wherein said fuel is a petroleum- and/or coal-derived or based fuel.

26. A fuel composition in accordance with claim 24 wherein said fuel is a petroleum crude oil.

27. A fuel composition in accordance with claim 24 wherein said fuel is a fossil fuel.

28. A fuel composition in accordance with claim 24 wherein said fuel is an ash-containing or ash-producing fuel when said fuel is combusted.

29. A fuel composition in accordance with claim 24 wherein said fuel additive composition is present in said fuel composition in an amount of at least about 0.05% by weight based on the ash content of said fuel.

30. A fuel composition in accordance with claim 24 wherein said fuel additive composition is present in said fuel composition in an amount in the range 0.001–10.0% by weight based on said fuel.

31. A fuel composition in accordance with claim 24 wherein said fuel is a vanadium-containing and sodium-containing fuel, the amount of said fuel additive composition present in said fuel composition being sufficient to provide at least about 3 parts by weight magnesium for each part by weight vanadium in said fuel, at least about 17 parts by weight Cl for each part by weight vanadium in said fuel and at least about a total of 17 parts by weight combined silicon and chromium for each part by weight sodium in said fuel, the amount of silicon to magnesium in said fuel additive composition based on $SiO_2$ and MgO formed from or capable of being provided by the silicon component and the magnesium component of said fuel additive composition when said fuel composition is combusted being in the weight ratio greater than 2 parts by weight $SiO_2$ to 1 part by weight MgO.

32. A fuel composition in accordance with claim 24 wherein said fuel is a vanadium-containing and/or sodium-containing fuel, the amount of said fuel additive composition present in said fuel composition being sufficient to provide at least 0.5 part by weight magnesium and chlorine for each part by weight vanadium in said fuel and at least a total of 0.5 part by weight silicon and chromium for each part by weight sodium in said fuel or in combustion products of said fuel, the amount of silicon to magnesium in said fuel additive composition based on $SiO_2$ and MgO formed from and/or provided by the silicon component and the magnesium component of said fuel additive composition when said fuel is combusted being in the weight ratio of at least 1 part by weight $SiO_2$ to 1 part by weight MgO.

33. A fuel composition in accordance with claim 32 wherein said fuel is a distillate petroleum fuel.

34. A fuel composition in accordance with claim 32 wherein the weight ratio of $SiO_2$ to MgO is greater than or at least 2.

35. In the combustion of a fuel for power generation or heat production or the like wherein the hot fuel combustion products come into contact with a metal surface subject to corrosion and/or deterioration due to contact by said hot combustion products, the improvement which comprises carrying out the combustion of said fuel in admixture with or in the presence of or by the addition to the hot fuel combustion products of a fuel additive composition in accordance with claim 1.

36. The combustion of a fuel in accordance with the improvement set forth in claim 35 wherein the fuel combusted is a vanadium-containing and/or sodium-containing fuel.

37. The combustion of a fuel in accordance with the improvement set forth in claim 35 wherein said fuel is a petroleum-or coal-based or derived fuel, the combustion being carried out under conditions such that when said fuel is combusted the resulting hot combustion products contain vanadium-containing and/or sodium-containing compounds.

38. The combustion of a fuel in accordance with the improvement set forth in claim 35 wherein said fuel is a vanadium-containing and/or sodium-containing fuel and additionally wherein the amount of said fuel additive composition present in or combusted with said fuel composition or in the hot fuel combustion products is sufficient to provide at least 0.5 part by weight each of magnesium and chlorine for each part by weight vanadium in said fuel or in said combustion products and at least a total of 0.5 part by weight silicon and/or chromium for each part by weight sodium in said fuel or in said combustion products, the amount of silicon to magnesium in said fuel additive composition based on $SiO_2$ and MgO formed from and/or provided by the silicon component and the magnesium component of said fuel additive composition being in the weight ratio of at least 1 part by weight $SiO_2$ to 1 part by weight MgO.

39. In the combustion of a fuel for power generation or heat production or the like wherein hot combustion products come into contact with a metal surface subject to corrosion and deposits due to contact by said hot combustion products containing vanadium in combined form and/or sodium in combined form, the impovement to reduce corrosion and ash deposition at a temperature of at least about 1400° F. which comprises providing in said vanadium-containing and/or sodium-containing hot combustion products at least 0.5 part by weight each of magnesium and chlorine for each part by weight vanadium in said hot combustion products and at least a total of 0.5 part weight silicon and/or chromium by each part by weight sodium in said hot combustion products, and providing in said hot combustion products an amount of $SiO_2$ and MgO such that the weight ratio of $SiO_2$ to MgO in said hot combustion products is at least 1.

40. The combustion of a fuel in accordance with the improvement set forth in claim 39 wherein said fuel is a fossil fuel.

41. The combustion of a fuel in accordance with the improvement set forth in claim 39 wherein said fuel is an ash-containing fuel.

42. The combustion of a fuel in accordance with the improvement of claim 39 wherein said fuel is a distillate fuel.

43. A process for operating a gas turbine by the combustion of a fuel wherein the resulting hot gaseous combustion products come into contact with the metal surfaces and blades of the gas turbine to drive or operate the same and produce a metal temperature in the gas turbine of about 1400° F. or higher and wherein the hot gaseous combustion products employed to drive or operate said gas turbine contain a vanadium-containing compound and/or a sodium-containing compound which comprises providing in the hot gaseous combustion products employed to operate or drive said gas turbine at least 0.5 part by weight each of magnesium and chlorine for each part by weight vanadium in said hot gaseous combustion products and at least a total of 0.5 part by weight silicon and/or chromium for each part by weight sodium in said hot gaseous combustion products and providing in said hot gaseous combustion products an amount of $SiO_2$ and MgO such that the parts by weight $SiO_2$ relative to the parts by weight MgO in the hot gaseous combustion products is at least 1.

44. A process in accordance with claim 43 wherein there is provided in the hot gaseous combustion products 1–10 parts by weight magnesium for each part by weight vanadium, 1–20 parts by weight chlorine for each part by weight vanadium, 1–25 parts by weight silicon plus chromium for each part by weight sodium and a weight ratio of $SiO_2$ to MgO in the range 2–12.

45. A process in accordance with claim 43 wherein there is provided in the hot gaseous combustion products 1–10 parts by weight magnesium for each part by weight vanadium, 1–20 parts by weight chlorine for each part by weight vanadium, 1–25 parts by weight silicon for each part by weight sodium and a weight ratio of $SiO_2$ to MgO in the range 2–12.

46. A process in accordance with claim 43 wherein there is provided in the hot gaseous combustion products 1–10 parts by weight magnesium for each part by weight vanadium, 1–20 parts by weight chlorine for each part by weight vanadium, 1–25 parts by weight chromium for each part by weight sodium and a weight ratio of $SiO_2$ to MgO in the range 2–12.

* * * * *

UNITED STATES PATENT AND TRADEMARK OFFICE

CERTIFICATE OF CORRECTION

PATENT NO. : 4,131,433

DATED : December 26, 1978

INVENTOR(S) : James F. Scott

It is certified that error appears in the above-identified patent and that said Letters Patent are hereby corrected as shown below:

Column 7, line 41, after "0.5" insert -- ppm --

Column 9, line 6, "Udiment" should read -- Udimet --

Column 10, line 26, after "6:1," insert -- while --

Column 12, line 51, "of" should read -- or --

Column 13, line 2, after "deposition", the phrase -- at a temperature of at least about 1400°F. -- should be inserted Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*